US009039330B1

(12) United States Patent
Olson et al.

(10) Patent No.: US 9,039,330 B1
(45) Date of Patent: May 26, 2015

(54) PIPE BORING SHIELD

(75) Inventors: Jeffrey L. Olson, Big Lake, MN (US); Lynnette A. Schillewaert, Becker, MN (US); Travis J. Drahota, Becker, MN (US)

(73) Assignee: LLAJ, Inc., Clear Lake, MN (US)

( * ) Notice: Subject to any disclaimer, the term of this patent is extended or adjusted under 35 U.S.C. 154(b) by 437 days.

(21) Appl. No.: 12/802,162

(22) Filed: Jun. 1, 2010

(51) Int. Cl.
*F16L 3/00* (2006.01)
*E03F 3/06* (2006.01)

(52) U.S. Cl.
CPC ..... *E03F 3/06* (2013.01)

(58) Field of Classification Search
USPC ..... 405/184.5, 138, 141, 146; 299/55–62; 175/61, 62
See application file for complete search history.

(56) References Cited

U.S. PATENT DOCUMENTS

| | | | | | |
|---|---|---|---|---|---|
| 2,656,683 | A | | 10/1953 | Riva | |
| 3,107,741 | A | | 10/1963 | Adams et al. | |
| 3,123,161 | A | | 3/1964 | Weber | |
| 3,174,562 | A | | 3/1965 | Stow | |
| 3,190,374 | A | * | 6/1965 | Caperan et al. | 175/74 |
| 3,402,781 | A | | 9/1968 | Sandburg | |
| 3,415,329 | A | | 12/1968 | Marlind | |
| 3,656,810 | A | | 4/1972 | Khodosh et al. | |
| 3,762,174 | A | | 10/1973 | Fikse et al. | |
| 3,767,836 | A | | 10/1973 | Geis et al. | |
| 3,917,010 | A | | 11/1975 | Fink | |
| 3,945,443 | A | | 3/1976 | Barnes | |
| 3,989,303 | A | * | 11/1976 | Akkerman | 299/31 |
| 4,013,134 | A | * | 3/1977 | Richmond et al. | 175/73 |
| 4,094,152 | A | | 6/1978 | Jutte | |
| 4,116,011 | A | | 9/1978 | Girault | |
| 4,159,149 | A | * | 6/1979 | Castanoli et al. | 299/80.1 |
| 4,176,985 | A | | 12/1979 | Cherrington | |
| 4,406,498 | A | * | 9/1983 | Akesaka | 299/11 |
| 4,456,305 | A | * | 6/1984 | Yoshikawa | 299/33 |
| 4,515,227 | A | * | 5/1985 | Cerkovnik | 175/65 |
| 4,576,515 | A | | 3/1986 | Morimoto et al. | |
| 4,624,605 | A | * | 11/1986 | Akesaka | 405/144 |
| 4,630,967 | A | | 12/1986 | Soltau | |
| 4,655,493 | A | * | 4/1987 | Sumi | 299/33 |
| 4,804,295 | A | * | 2/1989 | Kondo | 405/141 |
| 4,886,394 | A | * | 12/1989 | Akesaka | 405/141 |
| 4,886,396 | A | | 12/1989 | Akesaka | |
| 4,915,543 | A | | 4/1990 | Akesaka | |
| 4,936,709 | A | * | 6/1990 | Kimura | 405/184 |
| 5,072,992 | A | * | 12/1991 | Gorbunov et al. | 299/33 |
| 5,102,201 | A | * | 4/1992 | Akesaka et al. | 299/85.2 |
| 5,104,261 | A | * | 4/1992 | Anderson et al. | 405/142 |
| 5,125,768 | A | | 6/1992 | Ilomaki | |
| 5,205,613 | A | * | 4/1993 | Brown, Jr. | 299/31 |

(Continued)

*Primary Examiner* — Doug Hutton, Jr.
*Assistant Examiner* — Patrick Lambe
(74) *Attorney, Agent, or Firm* — Moss & Barnett

(57) ABSTRACT

A boring shield apparatus for attachment to a boring machine/jack for installing pipe sections underground is provided by this invention. Such invention comprises drill heads and a screw auger that rotate with respect to a non-rotating exterior housing. When the boring shield is operatively connected to the boring machine jack and moved forward into contact with the earth along the desired underground pathway for the pipeline, dirt is excavated by means of the rotating drill head and transferred inside a self-contained screw auger whereupon it is pushed safely away from the boring shield and boring machine. This boring shield apparatus pivots with respect to itself for enhanced steering capacity. It accommodates pipelines of larger diameter and length and rough exterior surface.

18 Claims, 10 Drawing Sheets

(56) References Cited

U.S. PATENT DOCUMENTS

| | | | | | |
|---|---|---|---|---|---|
| 5,211,510 | A | * | 5/1993 | Kimura et al. | 405/184 |
| 5,386,878 | A | | 2/1995 | Rowekamp | |
| 5,393,172 | A | * | 2/1995 | Akesaka | 405/141 |
| 5,403,122 | A | * | 4/1995 | Granella | 405/184 |
| 5,437,500 | A | * | 8/1995 | Lehmann et al. | 299/60 |
| 5,443,305 | A | * | 8/1995 | Heierli et al. | 299/33 |
| 5,452,967 | A | * | 9/1995 | Fuller | 405/184 |
| 5,456,552 | A | * | 10/1995 | Cherrington | 405/184 |
| 5,460,432 | A | * | 10/1995 | Yamazaki et al. | 299/106 |
| 5,470,132 | A | * | 11/1995 | Cartwright | 299/56 |
| 5,749,678 | A | | 5/1998 | Dose et al. | |
| 5,797,202 | A | * | 8/1998 | Akesaka | 37/189 |
| 5,813,482 | A | * | 9/1998 | Barbera | 175/61 |
| 5,846,027 | A | | 12/1998 | Fujii | |
| 6,017,095 | A | * | 1/2000 | DiMillo | 299/56 |
| 6,082,930 | A | * | 7/2000 | Miya et al. | 405/146 |
| 6,382,732 | B1 | * | 5/2002 | Tanaka et al. | 299/55 |
| 7,040,712 | B2 | * | 5/2006 | Sakae et al. | 299/55 |
| 7,510,025 | B2 | * | 3/2009 | Davies | 175/26 |
| 7,832,960 | B2 | * | 11/2010 | Home et al. | 405/146 |
| 8,113,741 | B1 | * | 2/2012 | Vidovic et al. | 405/184 |
| 8,210,774 | B1 | * | 7/2012 | Vidovic et al. | 405/143 |
| 2001/0010780 | A1 | * | 8/2001 | Matsumoto | 405/138 |
| 2008/0044232 | A1 | * | 2/2008 | Lauscher | 405/155 |
| 2008/0124178 | A1 | * | 5/2008 | Rohde et al. | 405/184.5 |
| 2009/0000824 | A1 | * | 1/2009 | Cao et al. | 175/62 |
| 2010/0028084 | A1 | * | 2/2010 | Dimillo | 405/138 |

* cited by examiner

PIPE BORING SHIELD

FIELD OF THE INVENTION

This invention relates to an apparatus for excavating underground tunnels for installing a pipeline. More specifically, the invention constitutes a boring shield used in association with a conventional boring machine for excavating horizontally without above-ground access a tunnel sized to receive concrete or metal pipe, and installing a pipeline therefor in a continuous fashion.

BACKGROUND OF THE INVENTION

Metropolitan regions are set on top of a network of pipelines. Metal pipelines carry water supplies between the municipal water supply provider and the various houses and businesses. Concrete or metal pipelines transport sewage from those houses and businesses to the city's sewage treatment plant. Concrete or plastic pipes safely carry storm water collected by drains positioned along the edges of roadways to prevent flooding. These various pipelines typically have outside diameters between 42-110 inches.

Such pipelines need to be buried underground beneath obstacles on the property like buildings, roadways, parking lots, etc. Some pipelines can be installed simply by excavating a trench within the ground surface, laying the pipeline, and then filling the remainder of the trench with the excavated earth. However, other pipelines may need to be installed too far below the ground surface to make excavation with a steam shovel or trenching machine practical. Moreover, new water, sewer, or storm pipelines may need to be installed underneath obstacles like roadways, rivers, and other already existing pipelines where surface excavation would be impossible. For these types of deeper pipelines, underground boring of a tunnel dimensioned to accept the installed pipeline is the only option.

U.S. Pat. No. 2,656,683 discloses, for example, a method of installing pipes or ducts under, e.g., a lake or canal. Vertical shafts are dug on either side of the river or canal at the start and stop points for the pipeline. A tubular guide is then pushed into the earthen wall of the shaft at the proper depth and orientation for the pipeline. A pipe section is then inserted into the guide and pushed forward by means of a hydraulic jack. Subsequent pipe sections are connected to the end of each preceding pipe section and pushed into the earth by the hydraulic jack until the desired length of pipeline is installed.

However, many soil types or conditions, let alone rocks, will impede the efficient jacking of a pipeline in this manner. Thus, boring machines have been used within the industry to remove earth ahead of the pipeline that is being installed. U.S. Pat. No. 3,107,741 issued to Adams et al. discloses such a boring machine consisting of a hydraulic ram on tracks for pushing the pipe sections forward into the earth. A shaft bearing an auger along its length and a drill head at its distal end extends through the pipe sections and is rotated by the boring machine. The drill head excavates earth ahead of the leading edge of the pipe, and the auger flights convey this earth back through the pipeline sections to the trailing end where it can be removed. As each pipe section is pushed forward into the earth by the hydraulic boring jack, the jack is stopped and moved backwards on the track to provide space for another pipe section to be connected to the trailing end of the pipeline with the processes repeated for excavating earth with the drill head and pushing the pipeline forward.

U.S. Pat. No. 3,123,161 issued to Weber teaches a cog wheel-based rotary cutting head. Again, the frame for supporting this rotary cutting head is simply inserted into the pipeline, itself. U.S. Pat. No. 4,116,011 issued to Girault discloses a method for excavating pipeline tunnels in which the excavation cross-section cut by the drill head is larger than the cross-sectional area of the pipe section to make it easier to push the pipeline forward into the earth. In this case, no auger for moving the excavated earth backwards is used. Drilling mud is then injected under pressure into the annular region between the pipe exterior surface and tunnel wall to fill it and prevent misalignment of the pipeline.

Rotary drill heads are known within the industry for use in association with borer jacks. See, e.g., Adams, as well as U.S. Pat. No. 4,630,967 issued to Soltau; U.S. Pat. No. 3,767,836 issued to Geis et al.; U.S. Pat. No. 4,936,709 issued to Kimura; U.S. Pat. No. 5,749,678 issued to Dose et al.; and U.S. Pat. No. 5,846,027 issued to Fujii. Screw augers for transporting the excavated earth backwards through the pipe being installed are also known. See, e.g., U.S. Pat. No. 3,402,781 issued to Sandberg; and U.S. Pat. No. 3,174,562 issued to Stow. However, such boring machines/jacks using such rotary drill heads and screw augers, alone or in combination, appear to simply be inserted inside the pipe sections being installed. This arrangement creates several disadvantages. First, the rotary cutter or scraper heads can easily come into contact with the interior pipe surface, thereby making this conventional arrangement unsuitable for concrete pipe. Second, because the screw auger simply throws the excavated earth backwards inside the pipe, it is dangerous for workers using shovels to remove the earth in close proximity with the rotating flights of the screw auger. Third, this conventional arrangement for a boring machine/jack only works well for relatively small diameter pipe (Soltau, for instance, discloses the use of 12-16-inch diameter pipe for his boring machine/jack), and even more particularly, smooth surfaced pipe made of plastic or metal.

Another challenge for rotary boring machines is the need to properly guide them along the appropriate pipeline path over long distances. U.S. Pat. No. 3,917,010 issued to Fink addresses this issue by using a plurality of roller cutters on the head of the rotating screw auger inside the pipe that can be independently rotated to alter the direction of the cut tunnel. U.S. Pat. No. 3,945,443 issued to Barnes discloses an earth boring machine having an adjustable steering head with cutters and a plurality of wedge means that are arranged circumferentially around the front casing/pipe section to bear against the bored rock/earth surface. However, these steering mechanisms only provide for smaller steering corrections, and do not work well for larger pipe diameters.

U.S. Pat. No. 5,386,878 issued to Rowekamp adds an air hammer bit at the end of his rotary auger to try to enhance the cutting action, as well as compressed air to move the excavated earth and rock material backwards to the rotating auger flights for transport backwards in the pipe sections. But, a worker cannot stand inside or near the pipe safely while this earth and rock debris is moving backwards inside the same pipe. See also U.S. Pat. No. 5,125,768 issued to Ilomaki. U.S. Pat. No. 4,176,985 issued to Cherrington discloses a pipe casing installation method employing a transport fluid and positive pressure for moving the earth and rocks inside the pipe. U.S. Pat. No. 4,576,515 issued to Morimoto et al. uses a viscosity-imparting liquid to soften the soil ahead of the cutter head, as well as to carry the earth at the head of the boring device outside of it to fill the annulus between the excavated hole and the pipe. The structure of the Morimoto boring machine prevents the excavated earth from entering the machine, and therefore contains no transport screw auger.

It would be advantageous to provide an improved boring machine/jack for installing pipe sections containing a rotating cutter that does not come into contact with the interior surface of the pipe, a self-contained screw auger that efficiently transports the excavated earth without letting it fall inside the pipe sections, and a steering mechanism for maintaining proper alignment of the pipeline, as it is installed. Such a boring machine/jack could be used in association with larger diameter pipe, including concrete pipe having higher frictional interaction with the earth.

SUMMARY OF THE INVENTION

A boring shield apparatus for attachment to a boring machine/jack for installing pipe sections underground is provided by this invention. Such invention comprises an outside housing containing an inside rotating drum. Operatively connected to the rotating drum is a drill head and a screw auger contained inside a carrier tube extending backwards from the drill head. When the boring shield is operatively connected to the boring machine jack and moved forward into contact with the earth along the desired underground pathway for the pipeline, dirt is excavated by the rotating drill head and transferred by means of paddles attached to the interior surface of the drum through a window of the carrier tube to be conveyed by means of the screw auger backwards through the pipeline sections whereupon it is pushed safely away from the boring shield and boring machine. This boring shield apparatus enables a pipeline of larger diameter, greater length, and rough exterior surface to be installed underground with increased efficiency and worker safety compared with conventional boring machines. Moreover, the boring shield pivots with respect to itself via hydraulic cylinders to enable the operator to steer the boring shield along the desired pipeline pathway.

DETAILED DESCRIPTION OF THE PREFERRED EMBODIMENT

A boring shield apparatus for attachment to a boring machine/jack for installing pipe sections underground is provided by this invention. Such invention comprises an outside housing containing an inside rotating drum. Operatively connected to the rotating drum is a drill head and a screw auger contained inside a carrier tube extending backwards from the drill head. When the boring shield is operatively connected to the boring machine jack and moved forward into contact with the earth along the desired underground pathway for the pipeline, dirt is excavated by the rotating drill head and transferred by means of paddles attached to the interior surface of the drum through a window of the carrier tube to be conveyed by means of the screw auger backwards through the pipeline sections whereupon it is pushed safely away from the boring shield and boring machine. This boring shield apparatus enables a pipeline of larger diameter and rough exterior surface to be installed underground with increased efficiency and worker safety compared with conventional boring machines. Moreover, the boring shield pivots with respect to itself via hydraulic cylinders to enable the operator to steer the boring shield along the desired pipeline pathway.

For purposes of the present invention, "pipe" means any pipe, tube, casing, culvert, duct, or other hollow structure of cylindrical or other shape used to transport liquids or gases underground.

Figure 1A:
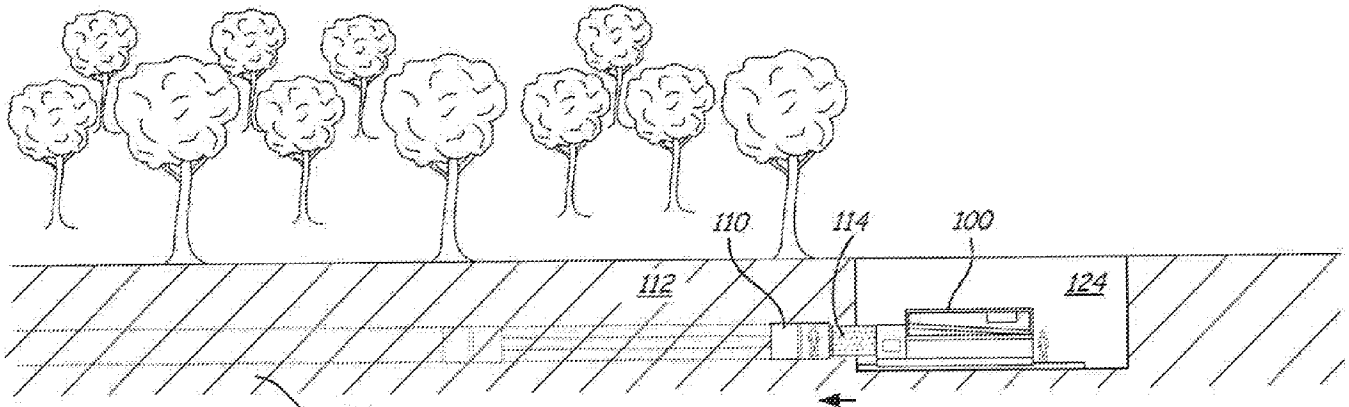
FIG. 1A is a schematic depiction of a boring machine using the boring shield of the present invention excavating a tunnel and installing the first pipe section underground for a pipeline.
Figure 1B:
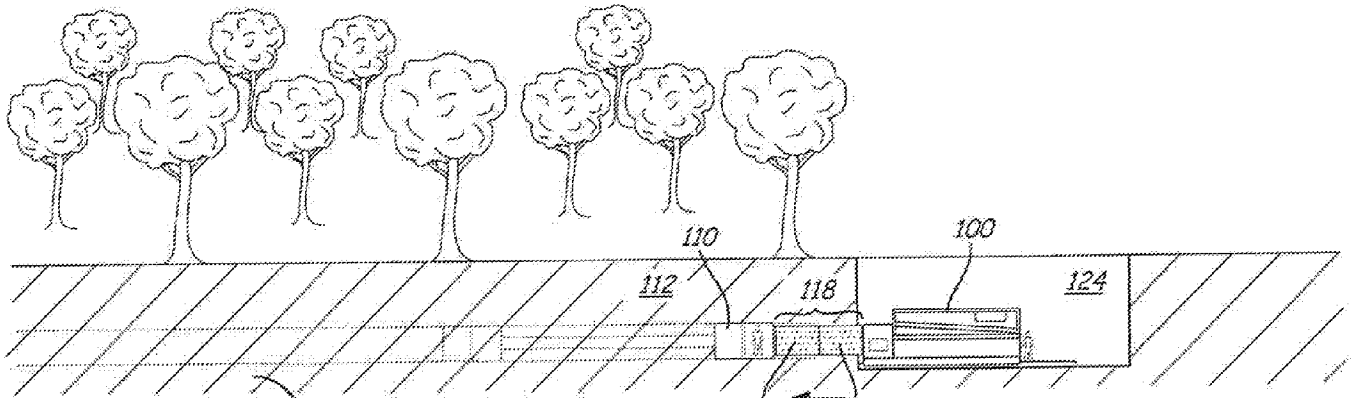
FIG. 1B is a schematic depiction of the second pipe section connected to the first pipe section being pushed into the excavated tunnel in the ground.

As shown in FIGS. 1A and 1B, boring machine 100 is used both to rotate boring shield 110 as it engages underground earth 112, and to provide constant forward pressure against pipe section 114 and boring shield 110 to push them collectively in a forward direction underground along predetermined pathway 116 for pipeline 118. As pipe section 120 is connected to pipe section 114 in front of it, and subsequent pipe sections to pipe section 120, a pipeline 118 is created. The boring machine 100, last-added pipe section 120, and initially the boring shield 110 are contained inside a vertical shaft 124 dug into the ground to accommodate the desired depth of pipeline 118.

Figure 2:
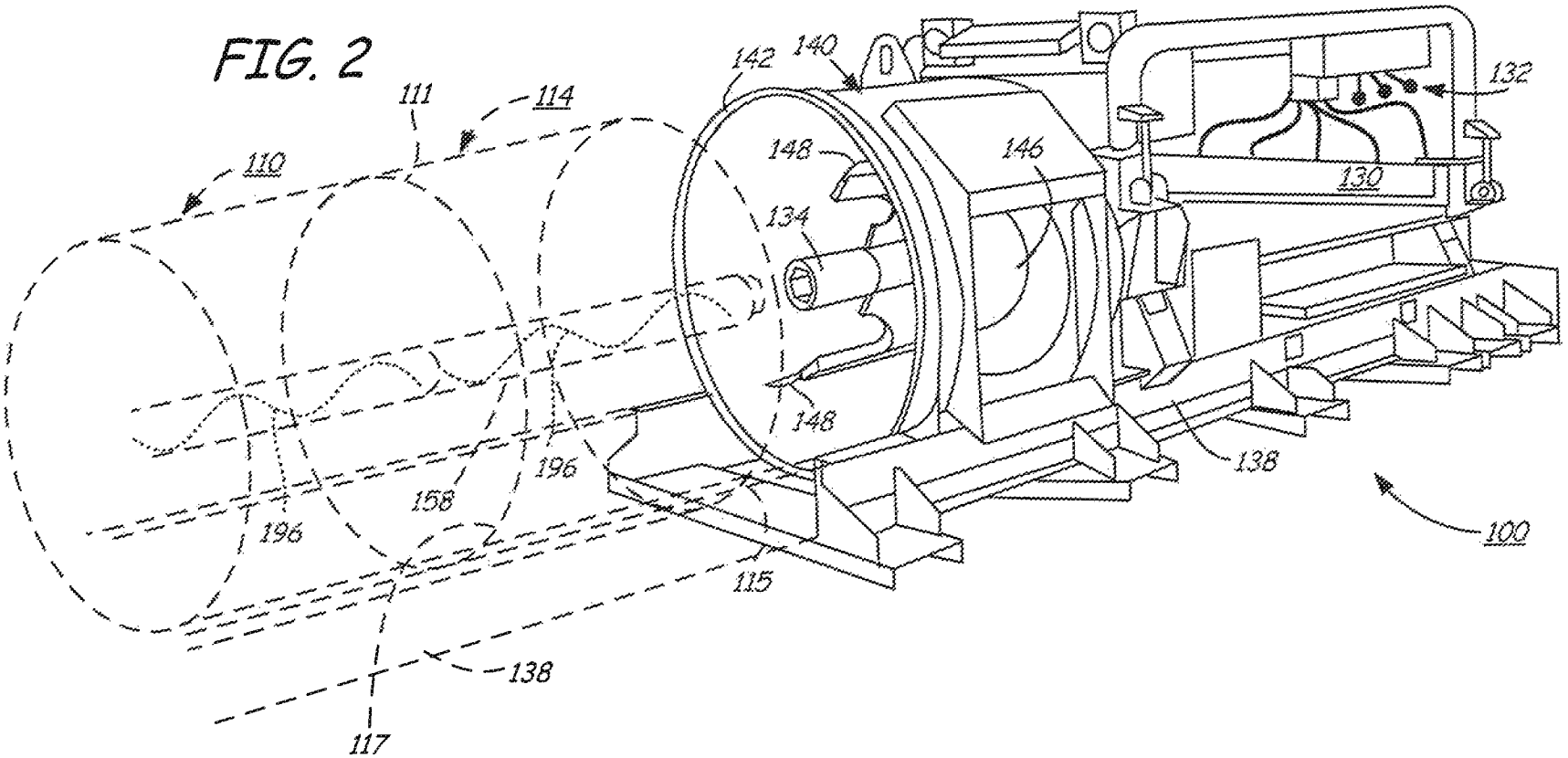
FIG. 2 is a perspective view of a boring machine used in association with the boring shield of the present invention.

The boring machine 100 may be sourced from any appropriate manufacturer, such as Barbco, Inc. of East Canton, Ohio. Shown in greater detail in FIG. 2 for horizontal boring, it comprises an internal diesel engine 130 and throttle controls 132 for improving rotational movement to hex drive 134. Model 48160-950, for example, is powered by a 174.2 hp Deutz diesel engine. This machine can produce 1,106,000 lbs. of actual forward thrust. It is equipped with a 5-speed transmission and a 54.2:1 gearbox, which produces 199,481 ft. lbs. of torque in first gear at 4 rpm to the 5-inch hex drive 134. The boring machine 100 is secured to horizontal track assembly 138, which extends forward a sufficient distance to accommodate the lengths of pipe section 114 and boring shield 110. The track 138 is anchored to the bottom of shaft 124 by means of a plurality of anchor pins. Leveling jacks are utilized to generally align the track assembly 138 in the desired direction of drilling.

In operation, the master pusher portion 140 of boring machine 110 moves forward along track 138 to press pipe 114 forward. Push collar 142 engages the trailing end 115 of pipe section 114. The forward end 117 of pipe section 114 engages the rear end 111 of boring shield 110. In this manner, master pusher 140 pushes pipe section 114 and boring shield 110 into earth 112 along the predetermined pipeline pathway 116.

Located in the wall of master pusher 140 is debris discharge window 146. Pusher paddles 148 extending radially inside from the interior surface of master pusher 140 serve to propel any excavated dirt, rocks, etc., removed from earth 112 by boring shield 110 through window 146 safely away from boring machine 100.

Figure 3:
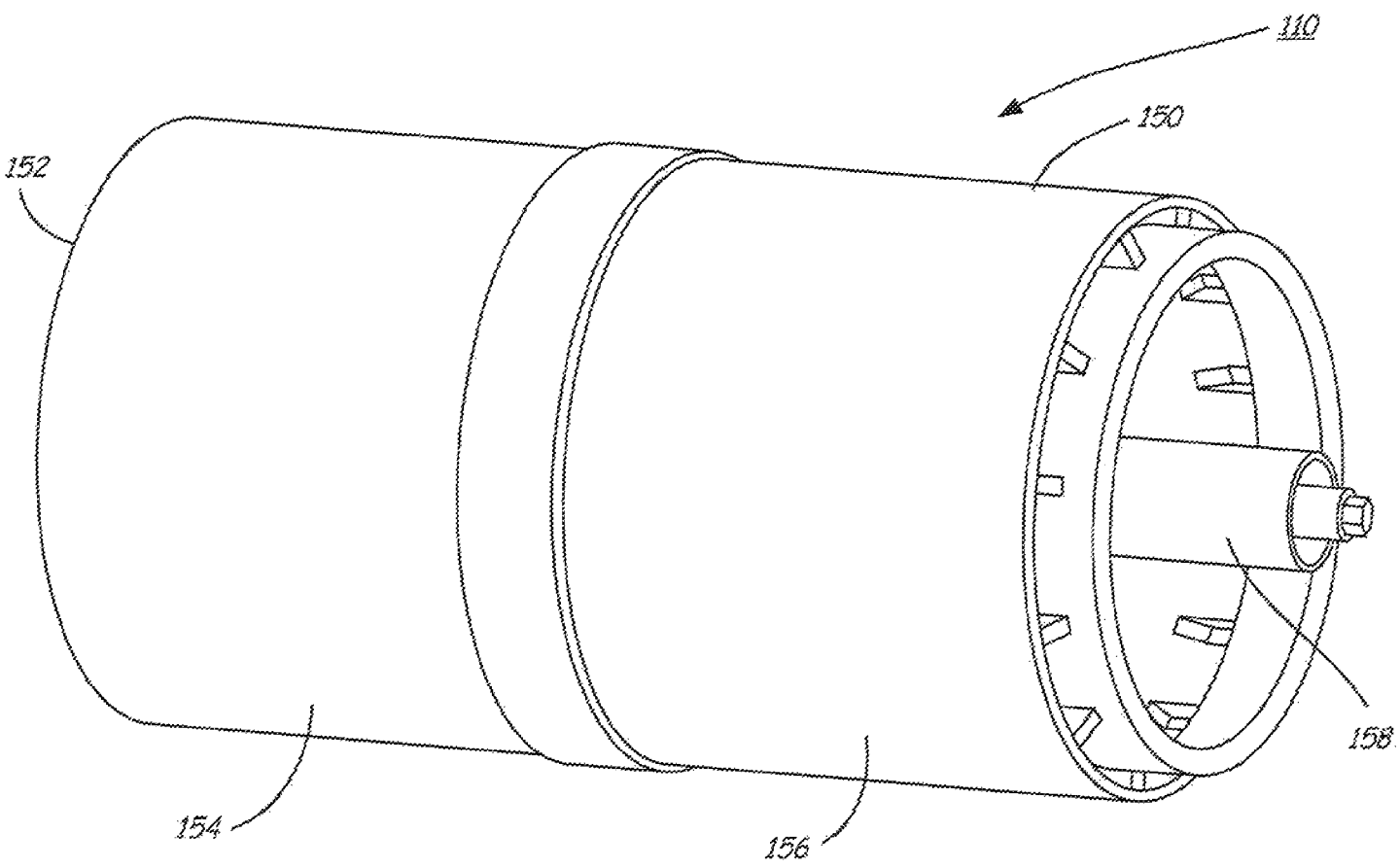
FIG. 3 is a perspective view of the boring shield from its rear end.
Figure 4:
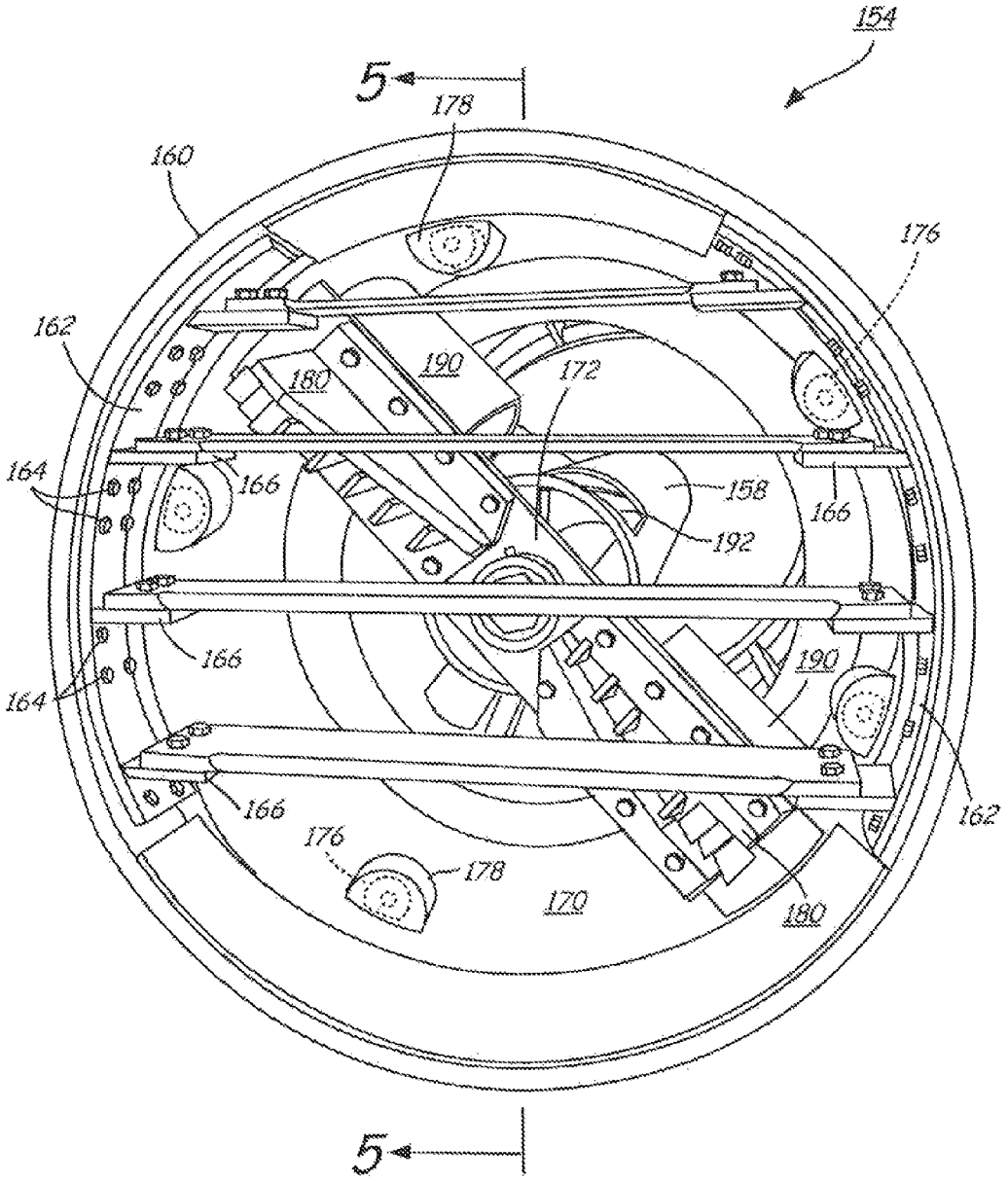
FIG. 4 is a slightly perspective view of the front end of the boring shield.

The boring shield 110 of the present invention is shown in FIG. 3 with its trailing end 150 visible. Exterior housing 152 contains the boring shield 110, and is divided into the engine portion 154 and caboose portion 156. The lead end of caboose 156 slides approximately 5 inches into the trailing end of engine 154 to allow the two portions to be connected to each other in a manner that will be described below, while enabling caboose 156 to pivot slightly with respect to engine 154 during the excavation process. Carrier tube 158 extends horizontally from the rear of caboose 156. Screw auger 196 is shown extending beyond carrier tube 158. The forward end 160 of engine portion 154 of boring shield 110 is shown in FIG. 4. It consists of exterior housing 152, which may be any appropriate shape, preferably cylindrical. The outside diameter of exterior housing 152 should approximate the outside diameter of the pipe section 114 immediately following boring shield 110, while being a little larger to enable pipe section 114 to be pushed by boring machines 100 into the tunnel hole created by the boring shield without undue resistance. If the outside diameter of housing 152 is much larger than the outside diameter of pipe section 114, however, an annular region between the tunnel wall and pipe wall will result which will need to be filled to ensure proper stability over time of the installed pipeline.

Mounted to the interior surface of engine 154 at its lead end are radial plates 162 by means, e.g., of bolts 164. Extending from radial plates 162 are a series of spaced brackets 166 spaced approximately ten inches apart from each other. Mounted to brackets 166 are the ends of bar plates 168, These bar plates 168 prevent large rocks and other debris from entering boring shield 110 as it is pushed into earth 112. They are also used when the boring shield must drill through sandy soils. In such case, the bar plates direct the flow of the sandy soil to be readily engaged by the scooper paddles 190 for transfer to the carrier tube.

Positioned inside engine housing 152 behind bar plates 168 is interior drum 170, which rotates inside housing 152 which does not rotate. Crossbar member 172 is attached at both of its ends to interior drum 170 to provide stability and strength. A series of roller bearings 176 contained inside protective covers 178 help interior drum 170 to rotate inside engine housing wall 152 while maintaining uniform spacing between interior drum 170 and exterior housing wall 152 around their entire circumference.

Bolted to crossbar member 172 are at least two rotary drill beads 180. As shown more clearly in FIG. 5., each rotary drill bead comprises a base portion 182 which is bolted to crossbar member 172 via a series of holes 184 for mating bolts. Central member 186 extends upwardly from base member 182 and has forged or attached to it a series of teeth 188. Rotary drill head may be made from any suitably strong and durable material for cutting earth, rocks, etc. Such materials include but are not limited to steel or cast iron, and carbide metals for the teeth.

Figure 5:
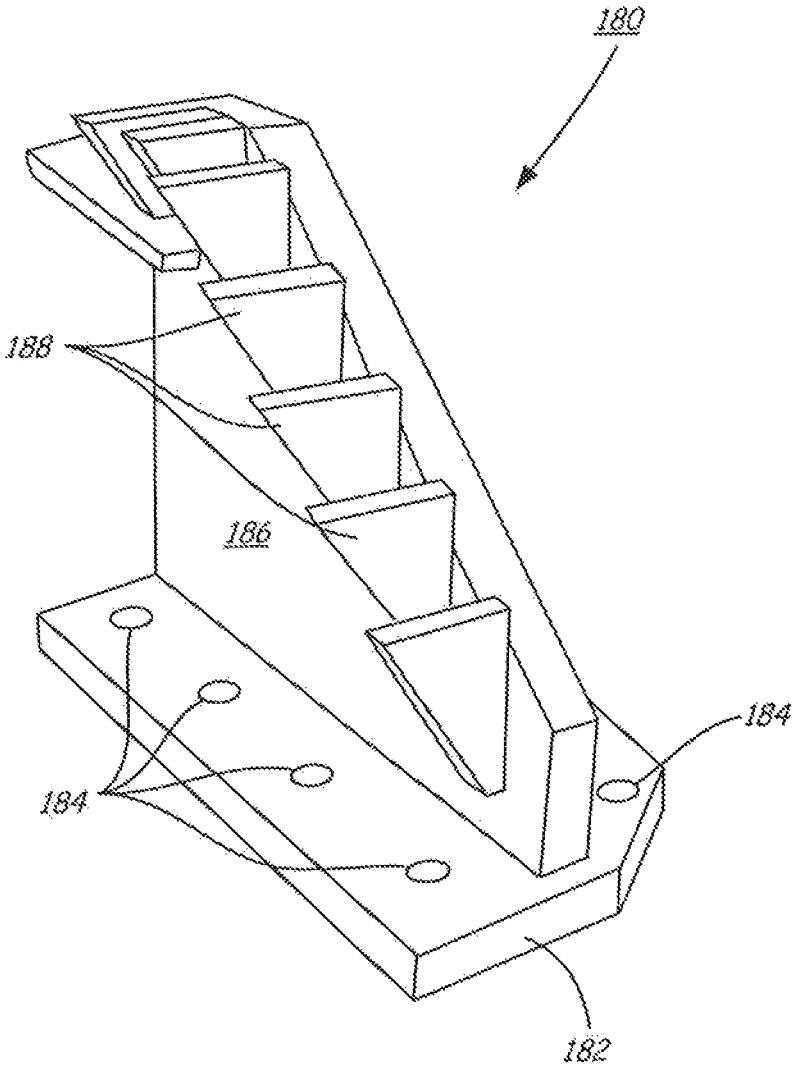
FIG. 5 is a perspective view of a rotary drill head for the boring shield.
Figure 6:
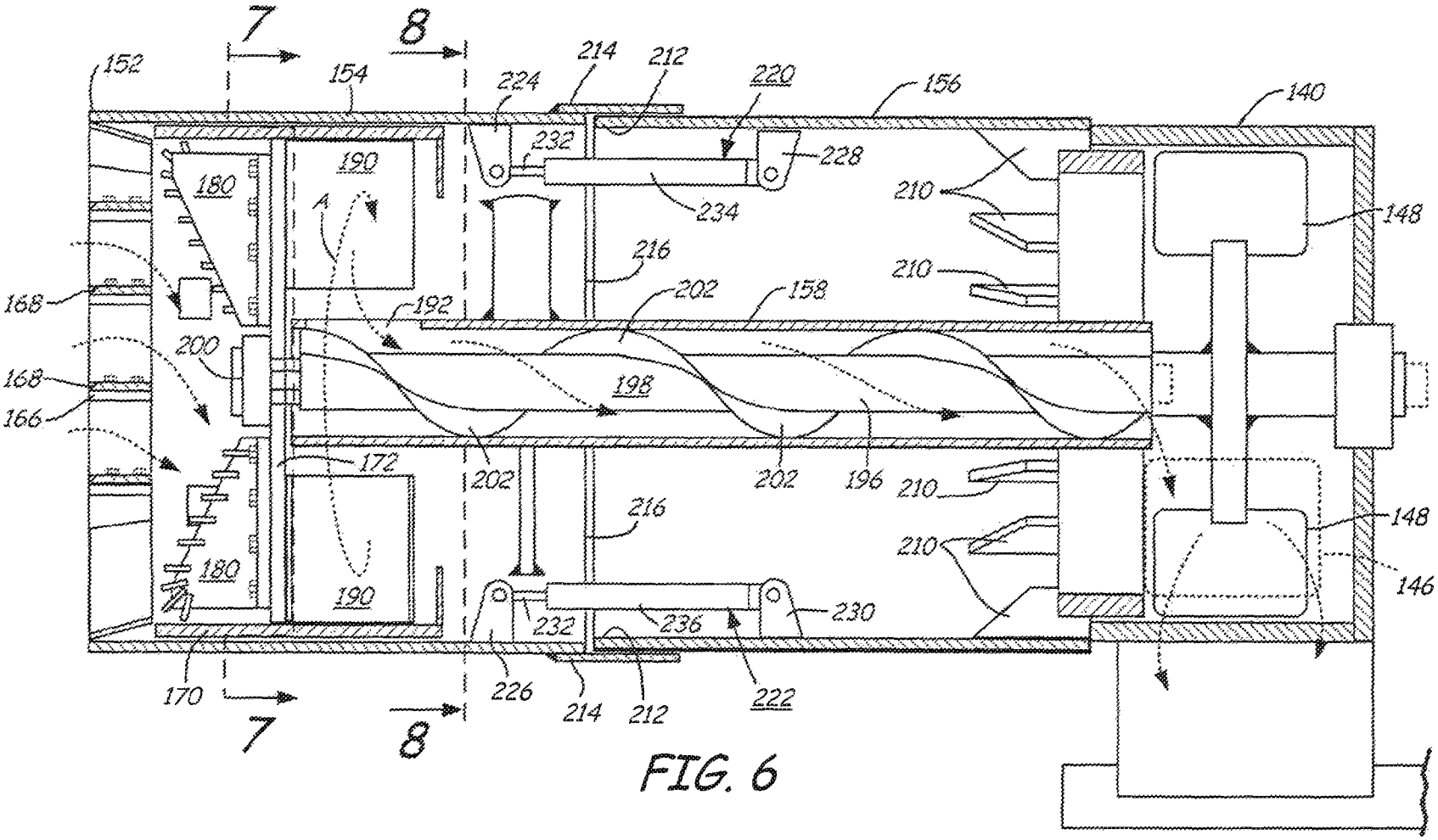
FIG. 6 is a cut-away view of the boring shield.
Figure 7:
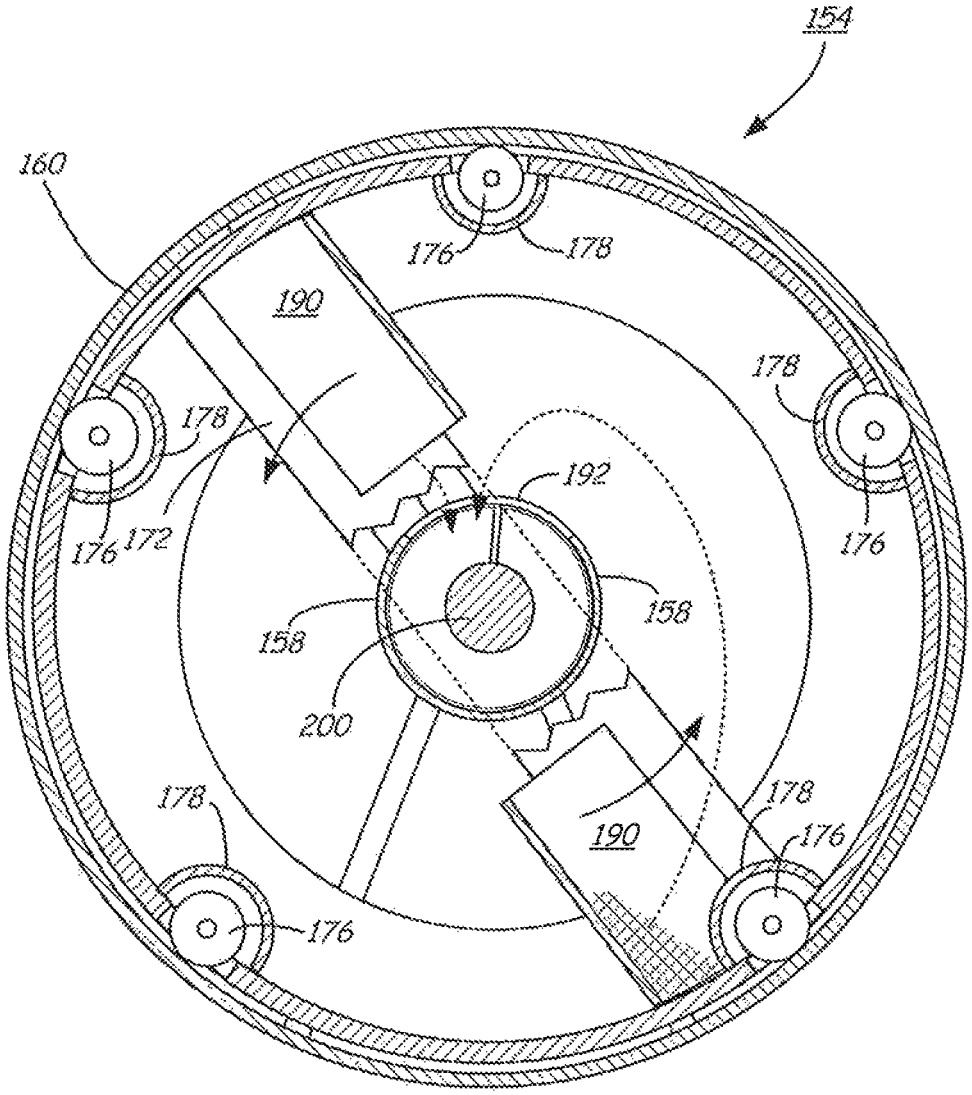
FIG. 7 is a cross-sectional view of the boring shield taken along line 7-7 in FIG. 6.
Figure 8:
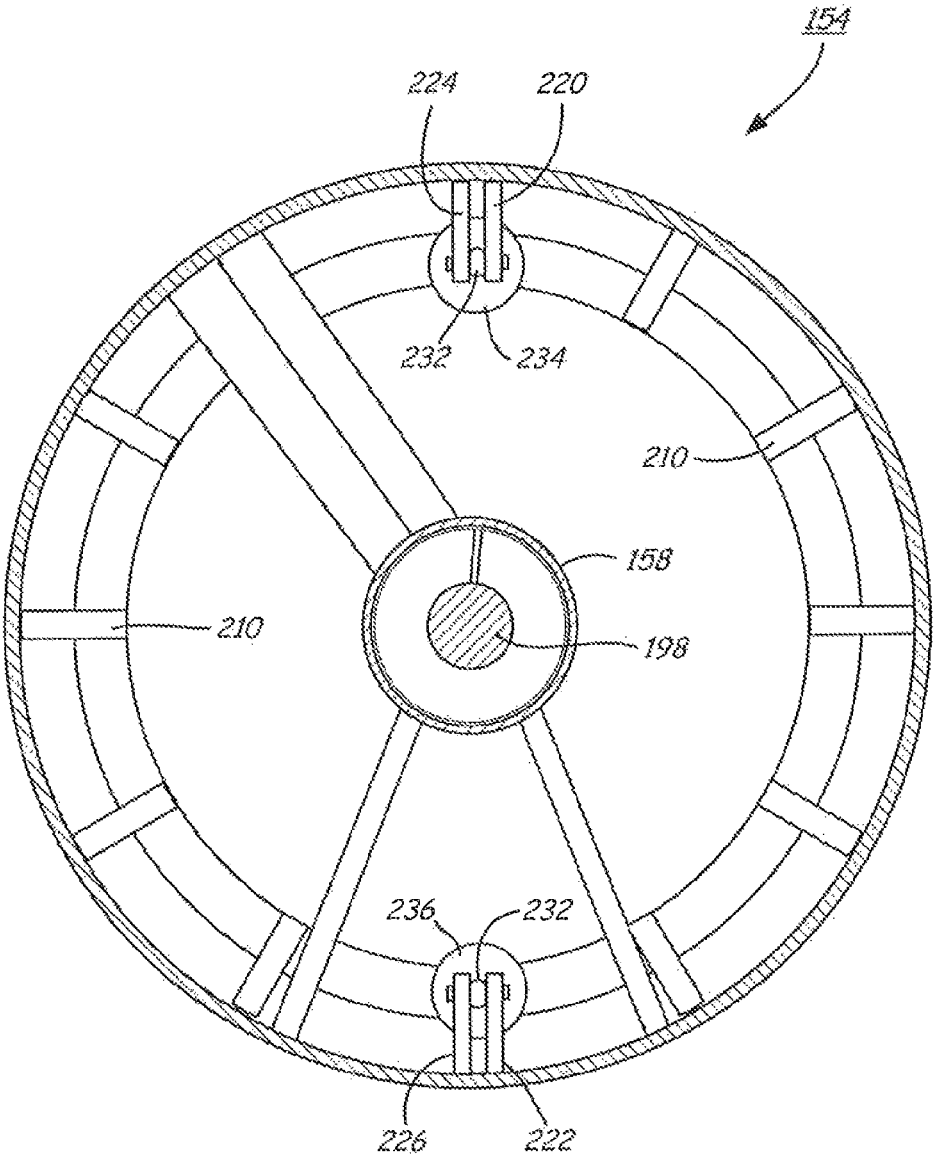
FIG. 8 is a cross-sectional view of the boring shield taken along line 8-8 in FIG. 6.

The configuration for the rotary drill heads 180 shown in FIGS. 4-5 is not the only one that can be used for the boring shield 110 of the present invention. Rather, any configuration that provides good interaction by the rotated teeth with the earth in front of the boring shield to tear, cut, and remove the earth to form the tunnel will suffice. Depending upon the soil type and pathway topography (e.g., under a lake or river), more aggressively designed drill heads like pneumatic or hydraulic hammer drills or pivoting drill heads may be used. However, because of the rotating drum and pivotable boring shield of the present invention, the rotary drill heads will work very well for most soil types.

Attached to the interior surface of interior drum 170 adjacent to crossbar member 172 are at least two scooper paddles 190. These scooper paddles 190 should be curved in shape for collecting dirt that is cut by rotary drill heads 180 and conveyed into the interior of rotating drum 170.

The rotary drill heads work very well for cutting and removing clay, fat clay, sandstone, limestone, and other types of dense or hard soils. For sandy soils with relatively loose particles, rotary drill heads may prove unnecessary, since the boring shield can simply scoop up the sandy soil and pass it via the rotating paddles into the carrier tube inlet window. Alternatively, drill heads with less aggressive tooth configurations may be used for these softer soil types.

Secured to the back surface of crossbar member 172 without actually being fixed to it is carrier tube 158. This carrier tube 158 does not rotate as interior drum 170, rotary drill heads 180, cross bar member 172, and paddles 190 collectively rotate in a clockwise direction A. Dirt that enters the interior of rotating drum 170 will be efficiently scooped up by paddles 190 and conveyed through entry window 192 into carrier tube 158.

Positioned along the interior length of carrier tube 158 is auger conveyor 196. This conveyor has shaft 198 which is mounted at its front end by means of bolt 200 to crossbar member 172. The back end of shaft 198 is securely mounted to hex drive 134 of boring machine master pusher 140. In this manner, rotation by boring machine 100 of its hex drive 134 rotates conveyor shaft 198 and, in turn, crossbar member 172, rotary drill heads 180, paddles 190, and interior drum 170. Auger flights 202 are helically formed around at least a substantial portion of the length of shaft 198. This auger conveyor 196 will efficiently transport all dirt that enters carrier tube 158 along its entire length until it reaches the interior of master pusher 140 of boring machine 110, whereupon it is discharged through window 146 by means of paddles 148.

Located along the rear interior region of caboose portion 156 of the boring shield 110 are a plurality of fins 210 extending radially around the perimeter of the circular opening. These fins have flat surfaces against which the leading edge of concrete pipe section 114 abut. In this manner, as boring machine 100 pushes pipe section 114 forward, the propulsive force is transferred to caboose 156 and therefore engine portion 154 too. The forward edge of steel pipe sections may directly abut the circumferential trailing edge of the boring shield housing 152 without the need for bearing surface fins 210. The leading edge 212 of caboose 156 fits inside collar 214 extending rearwardly from engine 154, and bears against reinforcement flange 216.

It is possible for the boring shield 110 to move out of alignment over long distances from the desired pathway 116 for the pipeline 122. It would be impractical to stop the boring machine 100, remove boring shield 110 and the pipeline installed, and reorient the boring machine along is proper path.

Figure 9A:
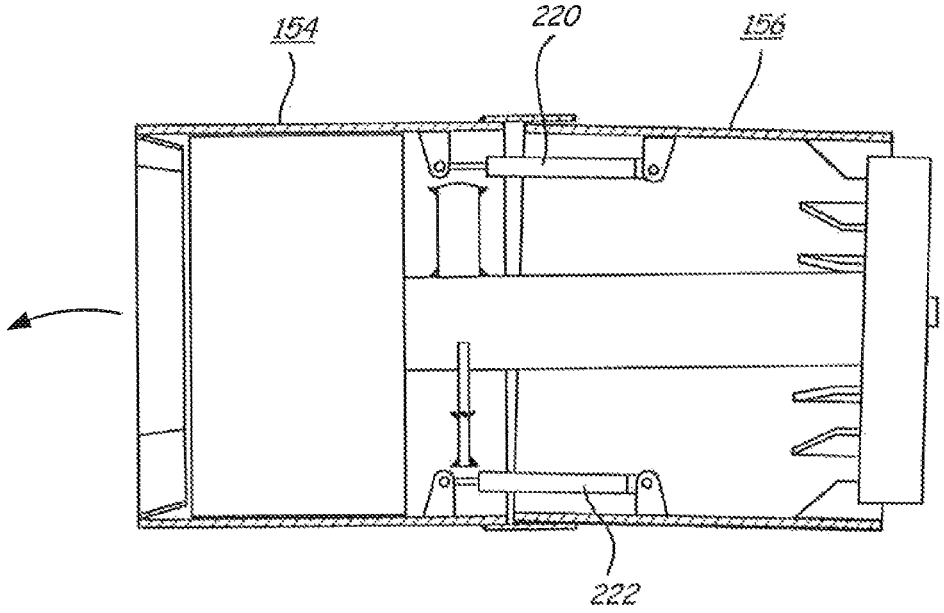
FIGS. 9A and 9B are cut-away views of the boring shield with the caboose section pivoted with respect to the engine section to move the boring shield down or up, respectively.
Figure 9B:
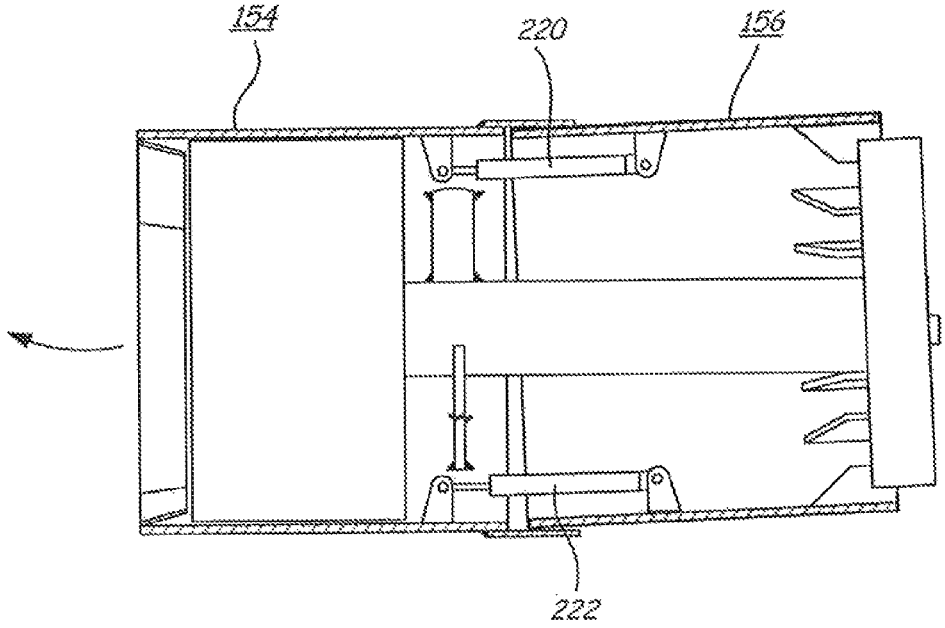

Instead, the boring shield 110 of the present invention has been designed to pivot within itself to provide a means for steering it. Caboose 156 fits within collar 214 of engine 154 and can therefore float with respect to engine 154. Hydraulic cylinders 220 and 222 are mounted between brackets 224 and 226 in engine 154 and brackets 228 and 230 in caboose 156. Piston rods 232 extend from the pistons contained within cylinder barrels 234 and 236, which also contain pressurized hydraulic fluid (oil). As the pressurized oil acts against one side or the other side of the piston, the piston rods will extend from or retract into the hydraulic cylinder to perform linear work. Thus, if the operator utilizes the controls (not shown) to extend hydraulic cylinder 220 while retracting hydraulic cylinder 222, then the top of engine 154 will move away from caboose 156 while its bottom moves closer, thereby causing boring shield 110 to point more downwards (see FIG. 9A). By the same token, if the operator causes hydraulic cylinder 220 to retract while hydraulic cylinder 222 to extend, then boring shield 110 will point in a more upward direction (see FIG. 9B). In this manner, boring shield 110 can be steered up and down by the operator to correct the bored pathway, or avoid an obstacle found in the earth 112.

Figure 10A:
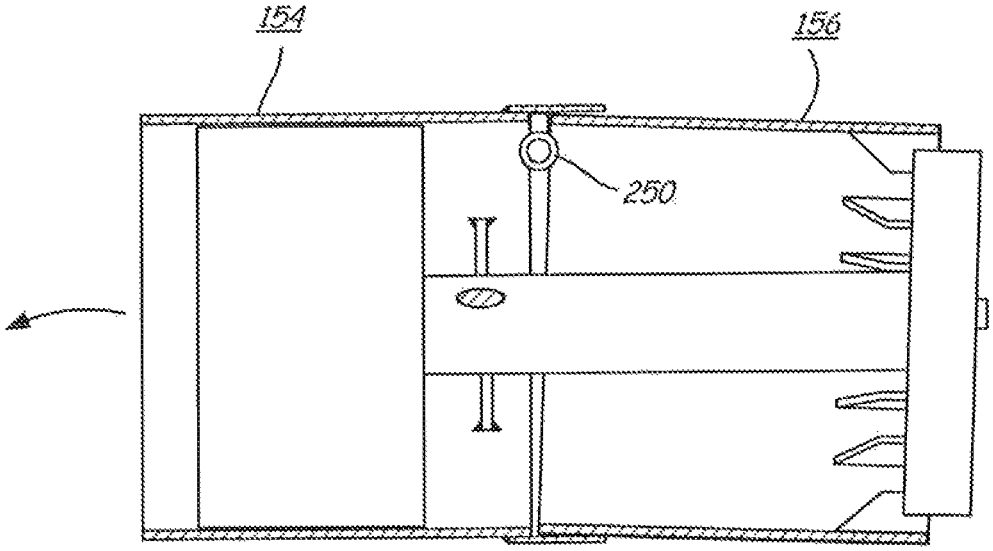
FIGS. 10A and 10B are cut-way views of the boring shield showing the use of a mechanical wedge for reorienting the boring shield to the left or right, respectively.
Figure 10B:
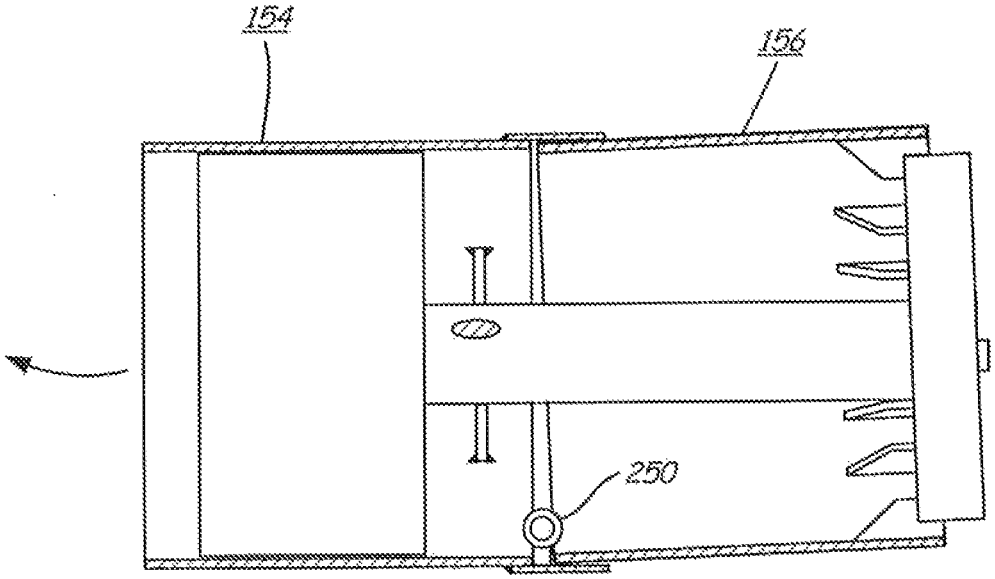
Figure 11:
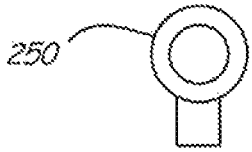
FIG. 11 is an elevational view of the wedge shown in FIGS. 10A and 10B.

Additional hydraulic cylinders can be added to the left and right sides of the caboose and engine interior surfaces to allow the operator to steer the boring shield to the left or right. Alternatively, wedges 250 (see FIG. 11) can be inserted between the distal edge of the exterior wall of caboose 156 and the collar wall 214 of the engine to turn the engine to the left with respect to the caboose (see FIG. 10A), or to the right (see FIG. 10B).

The boring shield 110 of the present invention can be used to excavate the tunnel pathway for concrete or steel pipes with boring machine 100 providing the propulsive force to push the successive pipe sections and boring shield 110 forward. Multiple pipe sections will successively be connected to each other to form the pipeline. With each new pipe section connected to the pipeline, an additional screw auger length and carrier tube length will need to be similarly attached to the boring shield, so that excavated dirt can be transported back along the entire length of the installed pipeline to the master pusher portion of the boring machine for discharge.

Boring shield 110 will preferably have a 57-85-inch (or larger) outside diameter. This will accommodate concrete pipe bearing typically a 42-60-inch (or larger) outside diameter, or steel pipe having typically a 48-84-inch (or larger) outside diameter. Such concrete pipe is commonly used for sanitary sewer and storm sewer pipelines. Steel pipe is commonly used for water main, storm sewer, sanitary sewer, and utility (e.g., phone or fiber optic wires) pipelines. Concrete pipelines may also be placed inside a steel casing where the pipeline runs underneath a railroad track or roadway or highway. Additionally, in some applications, plastic pipe can be installed inside steel case. The boring shield 110 of the present application can be used in association with the boring machine 100 to install the steel casing underground, followed by use of the boring machine 100 without the boring shield to push the concrete or plastic pipeline into place inside the steel casing.

The pipe sections 114 used in association with the boring shield 110 of the present invention can be 8-40 feet in length, preferably 20-foot long. Pipelines of 20-400 feet in length can easily be laid with the utilization of this invention. Pipeline lengths greater than 400 feet are possible. The boring shield 110 enables not only these longer than normal pipelines to be installed underground, but also concrete pipe and larger diameter pipe that cannot be installed by conventional boring machines.

Another advantage provided by the boring shield of the present invention is worker safety. Because the screw auger is safely encased inside the carrier tube, and all or most of the excavated dirt entering the boring shield is passed into this carrier tube, a worker can safely stand inside the caboose section of the boring shield away from the rotating screw auger and conveyed dirt. This worker can observe the boring shield at the direct point of its impact with the earth and help to orient it along the desired pathway for the pipeline.

The above specification and drawings provide a complete description of the boring shield of the present invention. However, the invention is capable of use in various other combinations, modifications, embodiments, and environments without departing from the scope of the invention. Therefore, the description is not intended to limit the invention to the particular form disclosed. Rather, the scope of the invention is defined by the appended claims.

We claim:

1. A boring shield for use in association with a boring machine having a rotated drive coupling for excavating an underground tunnel in earth for a pipeline, such boring shield comprising:

(a) an exterior housing having an interior surface and a longitudinal axis;

(b) a drum rotatably mounted inside the exterior housing along the same longitudinal axis as for the exterior housing, the drum having an exterior surface substantially parallel along its length with the interior surface of the exterior housing to maintain proper axial alignment of the drum with the exterior housing;

(c) at least one rotary drill head mounted to the forward end of the drum;

(d) a stationary carrier tube extending through the length of the drum and exterior housing, such carrier tube having an inlet window therein;

(e) a rotating screw auger positioned inside the stationary carrier tube, such screw auger having a forward end operatively connected to the drum and a rearward end operatively connected to the drive coupling of the boring machine;

(f) at least one paddle operatively connected to the inside of the drum;

(g) wherein the screw auger rotated by the boring machine drive coupling rotates the drum and rotary drill head mounted to the drum to remove earth by means of the rotated drill head and pass the earth inside the boring shield drum, whereupon the rotating paddle conveys the earth into the inlet window of the carrier tube for transport by the screw auger outside the rear of the exterior housing of the boring shield; and (h) a space in the exterior housing between the interior wall of the exterior housing and the stationary carrier tube large enough to accommodate a worker positioned inside the space while protecting the worker by the stationary carrier tube from injury by the rotating screw auger positioned inside the stationary carrier tube.

2. The boring shield of claim 1, wherein the rotary drill head has a plurality of teeth for cutting and removing earth to form the tunnel.

3. The boring shield of claim 1, wherein the rotary drill head is mounted to a crossbar member secured to the perimeter of the forward end of the drum to add stability to the drum.

4. The boring shield of claim 1 further comprising a plurality of bar plates mounted to the perimeter of the forward end of the housing in front of the drum to impede larger rocks or earth pieces from entering the rotating drum, or direct sandy soil into the drum.

5. The boring shield of claim 1, wherein the screw auger has a helically wound flight along a shaft for propelling earth contained inside the carrier tube along the carrier tube.

6. The boring shield of claim 1 further comprising a plurality of fins attached to the rear perimeter of the housing for providing bearing surfaces for a pipe section positioned between the boring shield and the boring machine.

7. The boring shield of claim 1, wherein the housing comprises a first section and a second section telescopically engaging such first section, so that such first section can pivot with respect to the second section.

8. The boring shield of claim 7 further comprising means for linearly moving the second housing section with respect to the first housing section in a non-axial manner.

9. The boring shield of claim 8, wherein such non-axial linear movement means comprises a hydraulic cylinder.

10. The boring shield of claim 8, wherein such non-axial linear movement means comprises a mechanical wedge.

11. The boring shield of claim 1, wherein a plurality of pipe sections are installed by the boring machine into the tunnel excavated by the boring shield to produce the pipeline.

12. The boring shield of claim 1, wherein the pipe section is formed from concrete, metal, or plastic.

13. The boring shield of claim 1, wherein the pipeline comprises a water main, sanitary sewer pipeline, storm sewer pipeline, or utility pipeline.

14. The boring shield of claim 1 further comprising at least one roller bearing mounted within the side wall of the drum with the roller bearing partially extending through an aperture in the side wall of the drum, wherein the roller bearing contacts the interior side wall surface of the exterior house to maintain axial alignment of the drum with the exterior housing when the drum rotates inside the exterior housing.

15. The boring shield of claim 2, wherein at least one of the plurality of teeth of the rotary drill is removable from the rotary drill for replacement or substitution.

16. The boring shield of claim 9, wherein at least two hydraulic cylinders are mounted inside the exterior housing, a first end of such hydraulic cylinders being mounted to the interior surface of the first housing section, and a second end of such hydraulic cylinders being mounted to the interior surface of the second housing section, wherein one hydraulic cylinder is operatively extended or shortened with respect to the degree of extension of the other hydraulic cylinder in order to pivot the first housing section and the drum, rotary drills, and carrier tube operatively connected thereto with respect to the second housing section.

17. The boring shield of claim 1, wherein the exterior surface of the drum is closely proximate to the interior surface of the exterior housing to maintain proper orientation of the drum with respect to the exterior housing.

18. The boring shield of claim 1, wherein the drum and exterior housing are both cylindrically shaped.

* * * * *